US005222887A

United States Patent [19]

Zabielski, Sr.

[11] Patent Number: 5,222,887

[45] Date of Patent: Jun. 29, 1993

[54] METHOD AND APPARATUS FOR FUEL/AIR CONTROL OF SURFACE COMBUSTION BURNERS

[75] Inventor: Martin F. Zabielski, Sr., Manchester, Conn.

[73] Assignee: Gas Research Institute, Chicago, Ill.

[21] Appl. No.: 823,330

[22] Filed: Jan. 17, 1992

[51] Int. Cl.[5] ..... F23N 5/08

[52] U.S. Cl. ..... 431/12; 431/42; 431/59; 431/79; 431/76

[58] Field of Search ..... 431/12, 42, 46, 59, 431/79, 76

[56] References Cited

U.S. PATENT DOCUMENTS

| | | | |
|---|---|---|---|
| 4,043,742 | 8/1977 | Egan et al. | 431/12 |
| 4,410,266 | 10/1983 | Seider | 431/79 |
| 4,516,929 | 5/1985 | Hiroi et al. . | |
| 4,545,009 | 10/1985 | Muraki et al. . | |
| 4,622,004 | 11/1986 | Dalhuisen . | |
| 4,638,789 | 1/1987 | Ueki et al. . | |
| 4,793,799 | 12/1988 | Goldstein et al. . | |
| 4,815,965 | 3/1989 | Likins, Jr. . | |
| 4,830,601 | 5/1989 | Dahlander et al. . | |
| 4,898,531 | 2/1990 | Goldstein et al. . | |
| 4,913,647 | 4/1990 | Bonne et al. . | |
| 4,927,350 | 5/1990 | Zabielski . | |
| 4,927,351 | 5/1990 | Hagar et al. . | |
| 4,934,926 | 6/1990 | Yamazaki et al. . | |
| 4,959,010 | 9/1990 | Burtscher et al. . | |
| 4,994,959 | 2/1991 | Ovenden et al. . | |
| 5,037,291 | 8/1991 | Clark . | |

*Primary Examiner*—Carroll B. Dority

*Attorney, Agent, or Firm*—McCormick, Paulding & Huber

[57] ABSTRACT

A fuel/air control system for use in controlling the operation of a surface combustion burner includes a photodetector that provides electrical signal equivalents of burner flame emission to a controller. The controller simultaneously receives signals indicative of the fuel/air mixture. The controller fits the emission and fuel air mixture data to a fourth order polynomial. Thereafter, the mathematical inflection point is computed and the corresponding fuel/air mixture is determined. The controller then generates command signals to adjust and maintain the burner at the inflection point fuel/air mixture. Multiple burner control can also be achieved with the present fuel/air control system without the need to sample exhaust gas.

19 Claims, 3 Drawing Sheets

METHOD AND APPARATUS FOR FUEL/AIR CONTROL OF SURFACE COMBUSTION BURNERS

TECHNICAL FIELD

The present invention relates generally to combustion processes and more particularly to a method and apparatus for controlling the fuel to air ratio of surface combustion burners.

BACKGROUND OF THE INVENTION

Surface combustion burners offer an excellent method for minimizing nitric oxide and carbon monoxide formation in gaseous fuel combustion, as well as providing high radiative heat transfer in commercial and industrial applications. The control of the fuel/air ratio or stoichiometry in these fully premixed systems is critical to realizing the benefits of this type of burner. To achieve control, fuel/air control techniques based on the optical emission from the burner surface have been developed in the past. Standard techniques rely on a sensor signal indicative of the amount of oxygen ($O_2$) or carbon monoxide (CO) in the flue gas to modify the fuel input to a burner. Apparatus operating in accordance with the prior art cannot effectively control systems with multiple burners, as the emission from each burner is co-mingled in the flue. Therefore, one burner may run fuel rich while another is running fuel lean.

U.S. Pat. No. 4,927,350 discloses a method of combustion control which determines at various loads a fuel/air peak relationship for the peak infrared radiation. A desired operating fuel/air ratio is computed as the offset between the relationship and the ratio. Recalibration of the control system is later established by determining the new fuel/air peak relationship and the offset is applied to control the surface combustion burner.

U.S. Pat. No. 4,959,010 discloses an automatically regulated combustion process. In the '010 process, fuel is mixed with an oxygen containing gas in an adjustable ratio. The exhaust gas produced by the burning is exposed to ultraviolet radiation, generating positive and negative charge carriers in the exhaust gas by means of a photoelectric charge separation process. The amount or kind of the positive and/or negative charge carriers is detected to produce a measurement value which reflects the amount and/or the charge of the carriers. A control signal is derived therefrom and the mixture ratio of the oxygen contained gas and the fuel (lambda factor) is adjusted in response to the control signal in order to improve the efficiency of the combustion.

U.S. Pat. No. 5,037,291 discloses a method and apparatus for optimizing fuel to air ratio in a combustion gas of a radiant burner. The flow rate of the gaseous fuel supply is held constant and the flow rate of the air supply is adjusted to change the relative proportion of air to fuel to an optimum value. A sensor is employed to measure the intensity of the radiation emitted by the burner while the air supply to the burner is varied. From the measurements obtained, the control parameters are derived which are then applied to set the air supply flow rate to a level that results in the optimum proportion of air and fuel in the mixture.

Still another burner control apparatus that analyzes an optical sensor signal is disclosed in U.S. Pat. No. 4,934,926. A burner operating air equivalence ratio is monitored. The burner is controlled by a method that measures OH radial spectral emission intensity at a base of a flame while combustion is in process. A linear relationship between the emission intensity and actual burner operating air equivalence ratio is used to determine that ratio while combustion is in progress. The computed ratio is compared with the desired burner operating air equivalence ratio to obtain the difference therebetween. The amount of air supplied to the burner is controlled on the basis of this difference.

U.S. Pat. No. 4,927,351 discloses a method and system for controlling the supply of fuel and air to a furnace. A controller is used with a plurality of burner assemblies in the '351 apparatus, each with its own air valve for controlling the flow of combustion air. A sensor is included with each burner for determining a condition reflecting the individual performance of the separate burner assembly. The controller operates each individual air valve in response to the performance reflecting conditions sensed by the sensors.

An air/fuel ratio controller is disclosed in U.S. Pat. No. 4,913,647. The '647 controller determines and regulates fuel/air mixture to maintain a predetermined fuel/air mixture by using a known relationship between the radiation intensity ratios of selected chemical species in the products of combustion and the fuel number as the basis to adjust the proportion of fuel within the air/fuel mixture to control the burner at the desired fuel number.

The fuel combustion control system disclosed in U.S. Pat. No. 4,545,009 makes use of an oxygen sensor in the exhaust gas as well as the amount in which the fuel control valve is opened with a corresponding fuel flow rate. A compensation coefficient is calculated by the system based on the estimated fuel flow rate and the actual fuel flow rate is controlled on the basis of the compensation coefficient. An estimated excess air ratio is calculated by the system using data representing the relationship between the opening rate of the air control damper and the air flow rate. The actual fuel flow rate and the air flow rate are controlled depending on the predetermined relationship of values between the estimated excess air ratio and the desired excess air ratio.

Another method for controlling a burner operation which utilizes an optical signal for feedback is used with the apparatus disclosed in U.S. Pat. No. 4,830,601. The '601 apparatus and method continuously monitors the burner flame during combustion by means of an optical sensor. The light therefrom is subject to spectral analysis for determining the instantaneous value of an air factor in the combustion gases. The intensity of the spectra of various compounds such as oxygen ($O_2$), carbon dioxide ($CO_2$) and hydrogen ($H_2$) are utilized in the '601 method. U.S. Pat. No. 4,622,004 discloses a gas burner system that includes a detector whose output signal is used by a control unit to determine the amount of carbon monoxide in the burnt gas. Whenever this concentration exceeds a certain predetermined limit, a control signal is sent to a fan or gas valve to vary the air to fuel mixture.

SUMMARY OF THE INVENTION

An object of the present invention is to provide a fuel/air control system which determines the onset of the increase of carbon monoxide in the emission of a burner.

Another object of the present invention is to provide a control system of the forgoing type that can be used with multiple burners.

Another object of the present invention is to provide a control system of the forgoing type that can simultaneously provide flame detection.

Still another object of the present invention is to provide a control system of the forgoing type that can select fuel/air ratio without actually measuring fuel, air flow or exhaust gas emissions.

According to the present invention, a system for use in controlling the operation of a burner includes a detector for generating electrical signal equivalents corresponding to the intensity of electromagnetic radiation from the burner flame, an air valve for providing a controlled flow of air to the burner in accordance with received air valve command signals and a fuel valve for providing a controlled flow of fuel to the burner in accordance with received fuel valve command signals. A controller is also included for generating the fuel valve and air valve signals such that a fuel/air ratio is established. The controller further has an apparatus for generating the fuel valve and air valve signals over a selected range of fuel/air ratios, an apparatus for sampling the detector means signals for each of said fuel/air ratios in the selected range and an apparatus determining a mathematical relationship between the sampled detector means signals and the selected fuel/air ratios. The controller has an apparatus for computing a first differential relationship from the mathematical relationship as well as a second differential relationship from the first differential relationship. An apparatus is provided for computing roots of a quadratic relationship wherein the second differential relationship is set equal to zero, for identifying the one of said roots that corresponds to a solution to the quadratic relationship within the fuel/air ratio selected range and for generating the air valve and fuel valve command signals to operate the burner at the fuel/air ratio corresponding to the acceptable root.

DESCRIPTION OF THE PREFERRED EMBODIMENT

Figure 1:
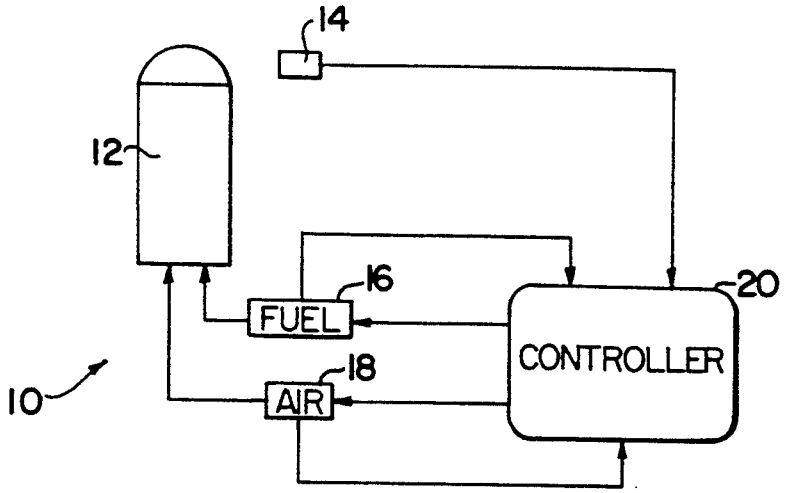
FIG. 1 is a simplified schematic illustration of a fuel/air control system provided according to the present invention.

Referring now to FIG. 1, there is schematically shown a control system 10 provided according to the present invention. Optical emission from a surface of a burner 12 is detected by a photodetector 14 for a range of fuel/air settings. The burner is preferably of the radiant or surface combustion type, such as an Alzeta standard PB (packaged burner) 50000 BTU/hr surface combustion burner, although those skilled in the art will note that the present control system can be adapted for use with other burners. These settings are chosen to span conditions from fuel lean to stoichiometric. The voltage from the photodetector is simultaneously measured with a voltage that is related to the amount(s) of air and/or fuel being premixed with the fuel from fuel valve 16 and air valve 18 such as a Honeywell valve (Model VR8450). A Westinghouse Varilink or its equivalent is preferably included to allow computer control of the air flow.

These several voltages are then stored in the memory of a controller 20 that includes a microprocessor of a known type. The microprocessor is required to analyze this data set in a unique manner that will be described below. As detailed hereinafter, the air or fuel flow is adjusted after processing to an optimum value which maximizes radiative transfer while maintaining acceptably low nitric oxide and carbon monoxide emissions. Moreover, the signal from the photodetector is continuously monitored by the controller to also provide flame out or flame loss detection.

Optical emission from the burner is detected by the photodetector 14, typically a photodiode (EC&G-VACTEC VTB1112) whose spectral response covered the range of 1.2 microns in the near infrared to 0.35 microns in the near ultraviolet. In order to avoid variations in irradiance due to surface inhomogeneities, it is also preferable that no point imaging of the surface be performed. Since the half-power acceptance angle of the photodetector is 15 deg, the surface area subtended thereby exceeds 5 $cm^2$. Depending upon the control system configuration, the output signal from the photodetector will be amplified by an appropriate amplification circuit e.g., an Analog Devices AD301 integrated circuit.

For those applications where Analog Devices amplification circuitry is employed, the controller can comprise an Analog Devices MACSYM 120 computer. This computer is a personal computer manufactured by IBM to industrial process control specifications for Analog Devices. The operating system for this "XT" class computer is Concurrent CPM86. Communication with the A/D and D/A ports on this computer is accomplished using a variant of BASIC developed by Analog Devices called MACBASIC. To ensure that no voltages exceeding 15 V are seen by the computer, a signal interface using optical isolators is used.

Figure 2:
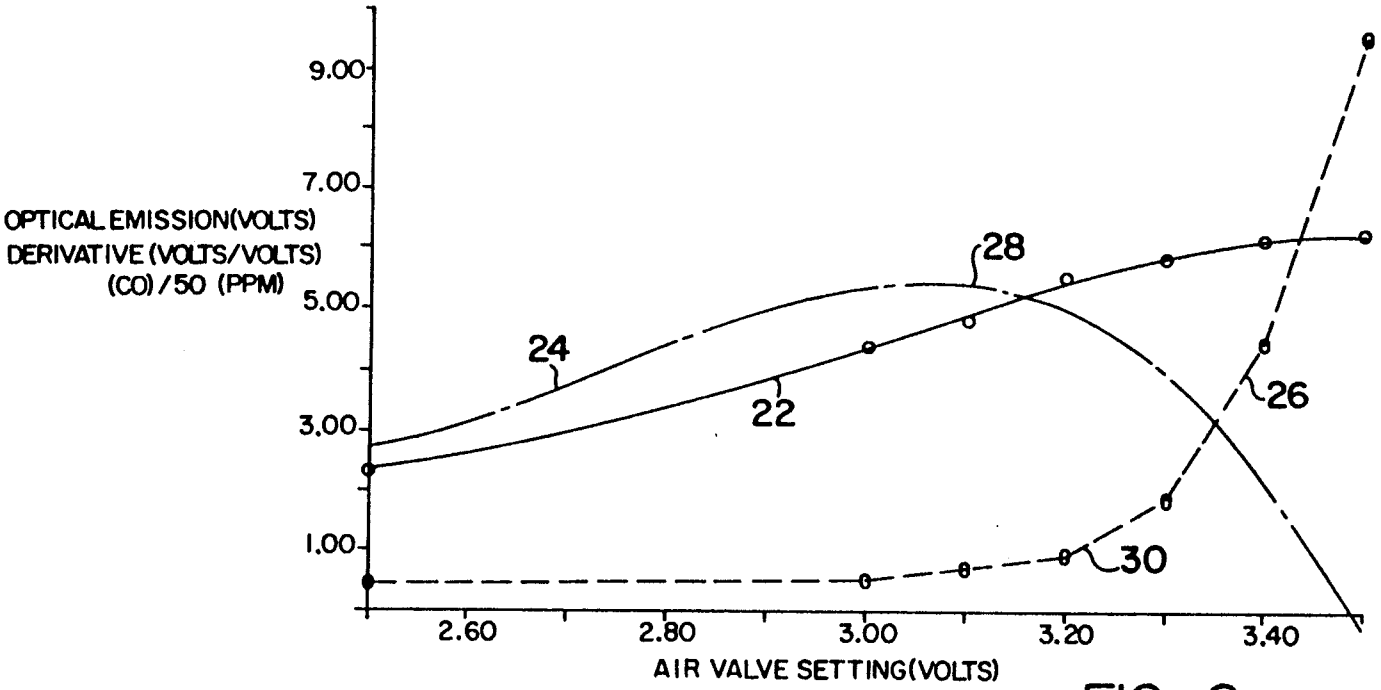
FIG. 2 is a diagram showing the relationship of several parameters processed by the control system of FIG. 1.

FIG. 2 shows at curve 22 broadband optical emission data as a function of the air valve signal voltage. The air valve signal increase corresponds to an increase in the quantity of air in the air/fuel mixture and is therefore also indicative of the fuel mixture. The radiation from the burner surface should follow the Stefan-Boltzmann relation; $R = e\sigma T^4$ where R is the radiance, e is the emissivity, $\sigma$ is the Stefan-Boltzmann constant and T is the absolute temperature. Consequently, the data are fitted with a fourth order polynomial $$\sum_{n=0}^{4} a_n X^n = Y$$

where Y is the detector voltage and x is the voltage related to air flow, as shown in FIG. 2. In this implementation, the fuel flow was held constant; however, there is no intrinsic reason why the air cannot be held constant and the fuel varied.

Also shown in FIG. 2, at curve 24 is the first derivative of the fitted function $$\frac{dY}{dX} = \sum_{n=1}^{4} na_n x^{(n-1)}$$

and an empirically derived curve 26 illustrating carbon monoxide concentration as a function of fuel mixture. Non-dispersive infrared analyzers or the equivalent thereof can be used to determine carbon monoxide (CO) content in the exhaust gas. Broadband (0.35 to 1.2 microns) optical emission data has been correlated with gas analyzer data obtained as a function of flame stoichiometry. The first derivative curve 24 goes through a maximum 28 where the carbon monoxide concentration begins to increase, i.e., at the carbon monoxide onset or carbon monoxide "knee" 30. An analysis of these data has demonstrated an excellent correlation between an inflection in the optical emission data and the knee of the CO production curve. The fuel/air ratio at the carbon monoxide onset is generally accepted as the most energy efficient With acceptable pollutant emissions.

The correlation between the peak in the first derivative of the fitted data and the carbon monoxide onset marks an important point of departure of the present invention over the prior art. Stated in different terms, the correlation between the inflection point in the fitted photodetector emission curve and the carbon monoxide "knee" Permits the fuel/air ratio to be adjusted to the optimum set Point without the need to actually measure the fuel flow, the air flow, and the stack gas emissions. By taking the second derivative of the fitted curve, setting it equal to zero $$\frac{d^2Y}{dx^2} = \sum_{n=2}^{4} n(n-1)a_n x^{(n-2)} = 0$$

and solving for the roots of the resulting quadratic equation, the air voltage at carbon monoxide "knee" is determined. Solving the second order equation produces two roots, only one of which is physically acceptable. In essence, the mathematical inflection point in the radiation curve versus fuel/air ratio occurs at the ideal fuel/air ratio.

Figure 3:
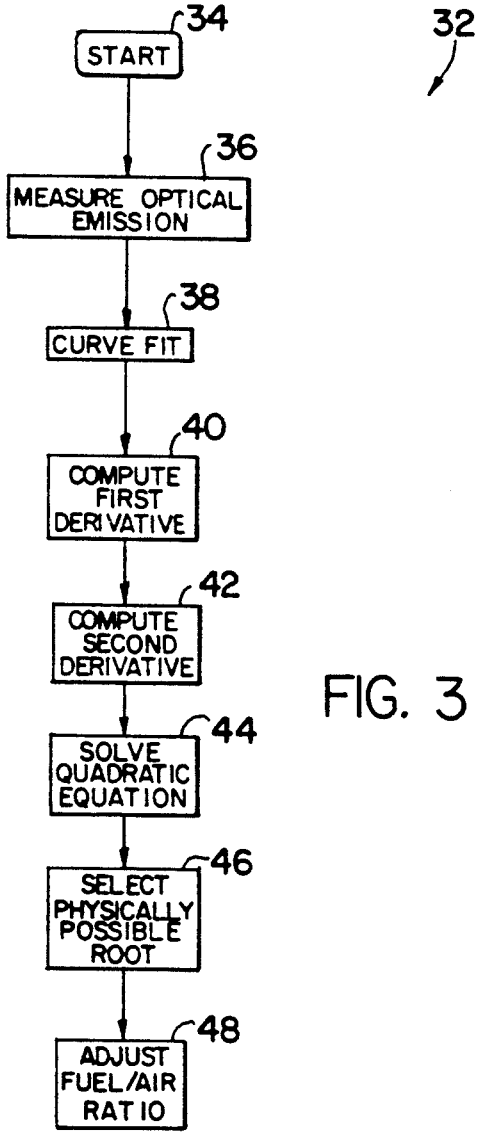
FIG. 3 is a diagrammatic illustration of a control algorithm executed by the control system of FIG. 1.

FIG. 3 is a simplified diagrammatic illustration of an algorithm 32 executed by the control system of FIG. 1. If the normal fuel and air metering controls on the burner are stable and the fuel source pressure does not vary dramatically, then the air inlet voltage can be readily set to the inflection point. At the intitialization (box 34), a reference inflection point is established. The optical emission data are obtained over a given stoichiometric range with sufficient points to establish the location of the inflection point described above (box 36). The measured data are processed by the controller to fit the equation set forth above (box 38). The first and second derivatives of the resulting function are computed at boxes 40, 42 and the resulting quadratic equation solved at box 44. The physically possible root is identified (box 46) and passed on to the controller so that the fuel/air ratio can be adjusted by the presentation of a command signal to the air or fuel valve (box 48).

Periodically, a new calibration curve can be determined and the air inlet voltage adjusted accordingly. How frequently, i.e., every quarter hour, half hour, hour, etc., can be tailored to the application. The control system can be configured to request the air valve inlet opening to achieve control within 3% of the computed radiation set point.

In addition to controlling to the inflection point, it is possible with a control system provided according to the present invention to add or subtract a given offset voltage to the inflection point voltage and maintain closed loop operation there. Consequently, operating points on either the lean or rich side of the inflection point can be chosen. In general, this cannot be reliably achieved in an analog control system due to electronic drift.

Figure 4:
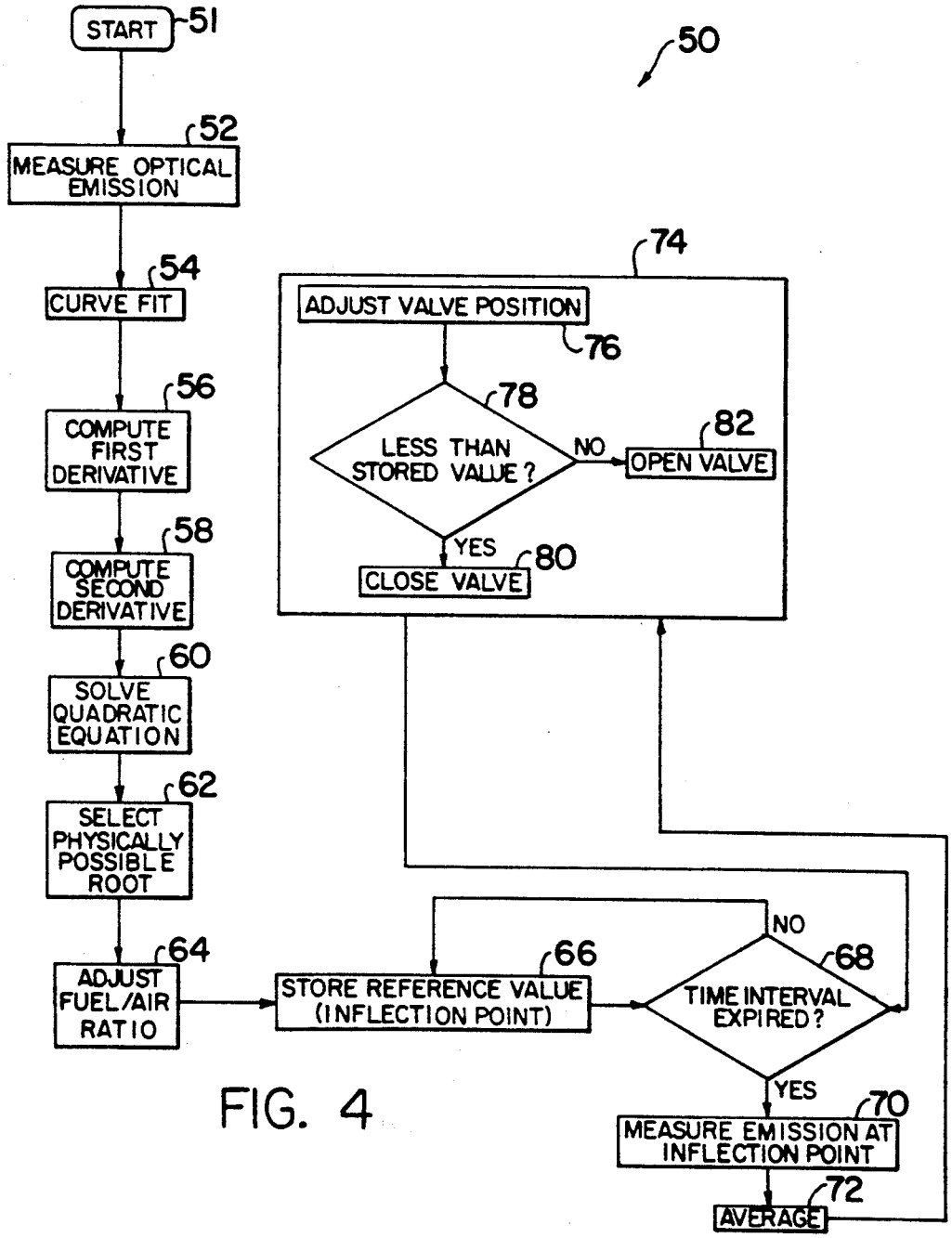
FIG. 4 is a diagrammatic illustration of a second control algorithm executed by the control system of FIG. 1.

For systems that experience major fluctuations in gas supply pressure, the time between recalibration may be a few minutes or less. In these situations, a continuously active mode of control is desirable. In order to implement such a control algorithm, modifications to the process described with respect to FIG. 3 are needed. FIG. 4 presents a diagrammatic illustration of such a modified control algorithm 50.

An initial calibration is performed to determine the inflection point exactly as described above. Initially (box 51) the optical emission data are obtained over a given stoichiometric range sufficient to establish the location of the inflection point described above (box 52). The measured data are processed by the controller to fit the equation set forth above (box 54). The first and second derivatives of the resulting function are computed at boxes 56, 58 and the resulting quadratic equation solved at box 60. The physically possible root is identified (box 62) and the fuel/air ratio is adjusted (box 64). The photodetector signal voltage level at the inflection point is thus measured and is stored in memory associated with the controller (box 66).

This stored photodetector voltage becomes the reference point in a control loop (box 68) that maintains constant emission from the burner. The emission from the burner is repeatedly measured (box 70) over a 0.050 second interval, averaged at box 72, and compared with the reference voltage at box 74. The controller adjusts valve position (box 76) as needed. If, at box 78, the value of the emission is less than that of the reference level, the controller generates command signals to increment the air valve closed (box 80). If the value of the emission is greater than the reference level, the air valve is incremented open (box 82). The algorithm then returns to box 68.

A deadband can be selected so that no adjustment in air valve position is made unless the measured value lies outside the deadband about the reference point. The amount of the increment can also be selected so that oscillations can be avoided, i.e., the damping of the system can be readily chosen for the particular application.

Data can be taken viewing different portions of the burner surface and the correlation between the inflection point and the onset of CO production should be excellent. Moreover, this behavior has been observed in the preferred embodiment even when the photodetector viewed a portion of the burner surface that had been damaged. In terms of signal voltage, the location of the peaks in the derivatives ranged from 2.92 to 3.06 volts. The excess air corresponding to this voltage varied from 33% to 26%, while the CO concentrations ranged from 22 to 35 ppm.

The data shown in FIG. 2 were taken with 9 photodiode that responds to radiation from the near infrared to the near ultraviolet. Moreover, the correlation between the radiation inflection point and the carbon monoxide onset applies if the radiation is limited to a narrow spectral region within this broad spectral range. Although not empirically extended to the mid-infrared region, the correlation should be valid even in the $CO_2$ and $H_2O$ bands in optically thick situations.

Optical interference and colored filters can be used to more sharply define the inflection point, but no significant increase in control system performance will be achieved. In addition, the output from the detector can be used for flame sensing by a thresholding, i.e., if the detector voltage drops below a specified voltage, a solenoid valve in the fuel line is closed. In the relatively clean environment of the preferred embodiment, this method of flame detection is reliable.

A distinct advantage of the present invention is that multiple burners can be precisely controlled. Control is superior to that provided by CO gas sensors in a common exhaust stack because the latter method can only measure overall CO, i.e., one burner can be running fuel-rich while another can be running fuel-lean, with the net effect of an acceptable CO level; but in fact both burners can be running inefficiently.

Similarly, although the invention has been shown and described with respect to a preferred embodiment thereof, it should be understood by those skilled in the art that various other changes, omissions and additions thereto may be made therein without departing from the spirit and scope of the present invention. For example, the above reference time interval used with the algorithm of FIG. 4 can be shortened or lengthened substantially, (e.g. approximately 15 minutes) according to the application.

I claim:

1. A system for use in controlling the operation of a surface burner generating a flame producing emissions having a carbon monoxide concentration, said system comprising:

a detector means for generating electrical signal equivalents corresponding to the intensity of electromagnetic radiation from said flame;

an air valve for providing a controlled flow of air to said surface burner in accordance with received air valve command signals;

a fuel valve for providing a controlled flow of fuel to said surface burner in accordance with received fuel valve command signals;

a controller for generating said fuel valve and air valve signals such that fuel/air ratio is established, said controller including a means for generating said fuel valve and air valve signals over a selected range of fuel/air ratios;

a means for sampling said detector means signals for each of said fuel/air ratios in said selected range;

a means for determining a mathematical relationship between said sampled detector means signals and said selected fuel/air ratios;

a means for computing a first differential relationship from said mathematical relationship;

a means for computing a second differential relationship from said first differential relationship;

a means for computing roots of a quadratic relationship wherein said second differential relationship is set equal to zero;

a means for identifying the one of said roots that corresponds to a solution to said quadratic relationship within said fuel/air ratio selected range, said identified root corresponding to a fuel/air ratio at which carbon monoxide onset occurs wherein the carbon monoxide concentration begins to increase in magnitude; and a means for generating said air valve and fuel valve command signals to operate the surface burner at the fuel/air ratio corresponding to the acceptable root.

2. The system of claim 1 wherein said mathematical relationship further comprises:

$$\sum_{n=0}^{4} a_n X^n = Y$$

where Y is said detector means signal value, $a_n$ corresponds to the coefficients satisfying the above fourth order polynomial equation and x is a signal value related to said air/fuel ratio.

3. The system of claim 2 wherein said first derivative relationship further comprises:

$$\frac{dY}{dx} = \sum_{n=1}^{4} n a_n x^{(n-1)}$$

where Y is said detector means signal value, $a_n$ corresponds to the coefficients satisfying the above fourth order polynomial equation and x is a signal value related to said air/fuel ratio.

4. The system of claim 1 wherein said quadratic relationship further comprises:

$$\frac{d^2Y}{dx^2} = \sum_{n=2}^{4} n(n-1) a_n x^{(n-2)} = 0$$

where Y is said detector means signal value, $a_n$ corresponds to the coefficients satisfying the above fourth order polynomial equation and x is a signal value related to said air/fuel ratio.

5. The system of claim 1 wherein said controller configures said fuel/air ratios by generating said fuel and air valve command signals to set said fuel valve flow at a preselected value and vary said air valve flow 6. The system of claim 1 wherein said controller configures said fuel/air ratios by generating said fuel and air valve command signals to set said air valve flow at a preselected value and vary said fuel valve flow.

7. The system of claim 1 wherein said detector means has a spectral response of approximately between 1.2 to 0.35 microns but not limited to this spectral range.

8. The system of claim 1 wherein said controller further comprises:

a means for storing said fuel/air ratio corresponding to the acceptable root as a reference value;

a means for sampling current detector means signals after the expiration of a time period;

a means for computing a current fuel air ratio from said current detector means signals; and a means for generating command signals for said air and fuel valves to adjust said fuel/air ratio to said reference fuel/air ratio.

9. The system of claim 8 wherein said time period approximately comprises 0.05 seconds.

10. The system of claim 8 wherein said time period approximately comprises 15 minutes.

11. A method for controlling the operation of a surface burner generating a flame producing emissions having a carbon monoxide concentration, said method comprising the steps of:

generating electrical signal equivalents corresponding to the intensity of electromagnetic radiation from said flame;

generating command signals for an air valve to provide a controlled flow of air to said surface burner;

generating command signals for a fuel valve to provide a controlled flow of fuel to said surface burner;

a controlling said fuel valve and air valve signals such that a fuel/air ratio is established including the steps of generating said fuel valve and air valve signals over a selected range of fuel/air ratios;

sampling said detector means signals for each of said fuel/air ratios in said selected range;

determining a mathematical relationship between said sampled detector means signals and said selected fuel/air ratios;

computing a first differential relationship from said mathematical relationship;

computing a second differential relationship from said first differential relationship;

computing roots of a quadratic relationship wherein said second differential relationship is set equal to zero;

identifying the one of said roots that corresponds to a solution to said quadratic relationship within said fuel/air ratio selected range, said identified root corresponding to a fuel/air ratio at which carbon monoxide onset occurs wherein the carbon monoxide concentration begins to increase in magnitude; and generating said air valve and fuel valve command signals in accordance with said acceptable root to operate said surface burner at said identified root.

12. The method of claim 11 further comprising the steps of:

storing said fuel/air ratio corresponding to the acceptable root as a reference value;

generating current electrical signal equivalents corresponding to the intensity of electromagnetic radiation from said flame after the expiration of a time period;

computing a current fuel air ratio from said current electrical signal equivalents of said flame; and generating command signals for said air and fuel valves to adjust said fuel/air ratio to said reference fuel/air ratio.

13. The method of claim 11 wherein said mathematical relationship further comprises:

$$\sum_{n=0}^{4} a_n X^n = Y$$

where Y is said detector means signal value, $a_n$ corresponds to the coefficients satisfying the above fourth order polynomial equation and x is said air/fuel ratio.

14. The method of claim 11 wherein said first derivative relationship further comprises:

$$\frac{dY}{dx} = \sum_{n=1}^{4} n a_n x^{(n-1)}$$

where Y is said detector means signal value, $a_n$ corresponds to the coefficients satisfying the above fourth order polynomial equation and x is said air/fuel ratio.

15. The method of claim 11 wherein said quadratic relationship further comprises:

$$\frac{d^2Y}{dx^2} = \sum_{n=2}^{4} n(n-1)a_n x^{(n-2)} = 0$$

where Y is said detector means signal value, $a_n$ corresponds to the coefficients satisfying the above fourth order polynomial equation and x is said air/fuel ratio.

16. In a system for use in controlling the operation of a surface burner having a detector means for generating electrical signal equivalents corresponding to the intensity of electromagnetic radiation from a surface burner flame producing emissions having a carbon monoxide concentration, an air valve for providing a controlled flow of air to said surface burner in accordance with received air valve command signals, a fuel valve for providing a controlled flow a fuel to said surface burner in accordance with received fuel valve command signals, a controller for generating said fuel valve and air valve signals such that a fuel/air ratio is established, said controller comprising:

a means for generating said fuel valve and air valve signals over a selected range of fuel/air ratios;

a means for sampling said detector means signals for each of said fuel/air ratios in said selected range;

a means for determining a mathematical relationship between said sampled detector means signals and said selected fuel/air ratios;

a means for computing a first differential relationship from said mathematical relationship;

a means for computing a second differential relationship from said first differential relationship;

a means for computing roots of a quadratic relationship wherein said second differential relationship is set equal to zero;

a means for identifying the one of said roots that corresponds to a solution to said quadratic relationship within said fuel/air ratio selected range, said identified root corresponding to a fuel/air ratio at which carbon monoxide onset occurs wherein the carbon monoxide concentration begins to increase in magnitude; and a means for generating said air valve and fuel valve command signals to operate the surface burner at the fuel/air ratio corresponding to the identified root.

17. The system of claim 1 further comprising a second burner generating a second flame, a second air valve for providing a controlled flow of air to said second burner in accordance with received second air valve command signals; and a second fuel valve for providing a controlled flow of fuel to said second burner in accordance with received second fuel valve command signals;

wherein said controller generates said second air valve and fuel valve command signals to operate the second burner at the fuel/air ratio corresponding to said acceptable root.

18. The system of claim 1 wherein said controller generates said air valve and fuel valve command signals to operate the burner at a fuel/air ratio displaced from said acceptable root.

19. The system of claim 8 further comprising a means for generating command signals for said air and fuel valves to adjust said fuel/air ratio only if said current air/fuel ratio lies outside a band of selected air/fuel ratios centered about said reference fuel/air ratio.

* * * * *